US010711541B2

(12) United States Patent
Haggart et al.

(10) Patent No.: US 10,711,541 B2
(45) Date of Patent: Jul. 14, 2020

(54) PORTABLE BUCKING FRAME

(71) Applicant: Pro Torque Connection Technologies Ltd., Edmonton (CA)

(72) Inventors: Steven Haggart, Spruceview (CA); Landon McDonald, Armstrong (CA)

(73) Assignee: Pro Torque Connection Technologies, Ltd., Edmonton (CA)

( * ) Notice: Subject to any disclaimer, the term of this patent is extended or adjusted under 35 U.S.C. 154(b) by 0 days.

(21) Appl. No.: 16/405,694

(22) Filed: May 7, 2019

(65) Prior Publication Data

US 2019/0345783 A1 Nov. 14, 2019

Related U.S. Application Data

(60) Provisional application No. 62/668,583, filed on May 8, 2018.

(51) Int. Cl.
*E21B 19/16* (2006.01)

(52) U.S. Cl.
CPC ..... *E21B 19/161* (2013.01); *E21B 19/165* (2013.01)

(58) Field of Classification Search
CPC ..... E21B 19/161; E21B 19/165; E21B 19/16; E21B 19/168
See application file for complete search history.

(56) References Cited

U.S. PATENT DOCUMENTS

| | | | | |
|---|---|---|---|---|
| 4,250,773 | A * | 2/1981 | Haynes | E21B 19/164 81/57.18 |
| 4,869,137 | A | 9/1989 | Slator | |
| 10,060,203 | B2 * | 8/2018 | Dore | E21B 19/155 |
| 2015/0113792 | A1 * | 4/2015 | Jacobs | E21B 19/163 29/559 |

* cited by examiner

*Primary Examiner* — James G Sayre

(57) ABSTRACT

A portable bucking frame for making and breaking tubular connections includes a base, a pair of back-up jaws movably mounted to the base for receiving a pipe and an adapter plate mounted on the front end of the base. The adapter plate is configured to receive one of a plurality of power tongs for making or breaking pipe connections.

17 Claims, 9 Drawing Sheets

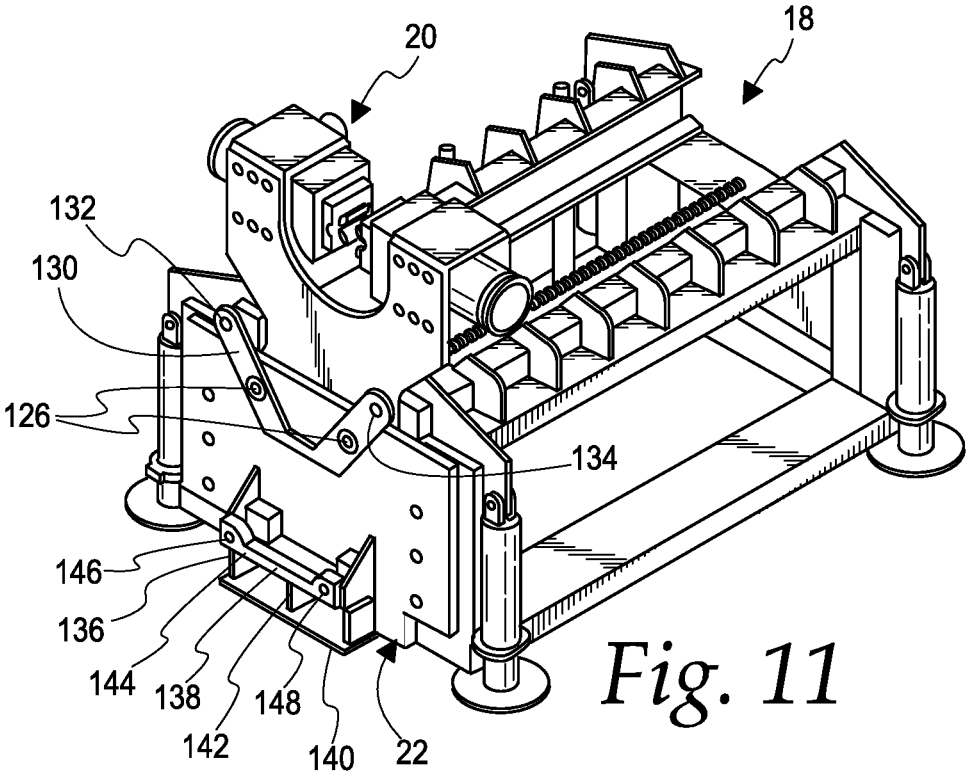
Fig. 11
Fig. 12
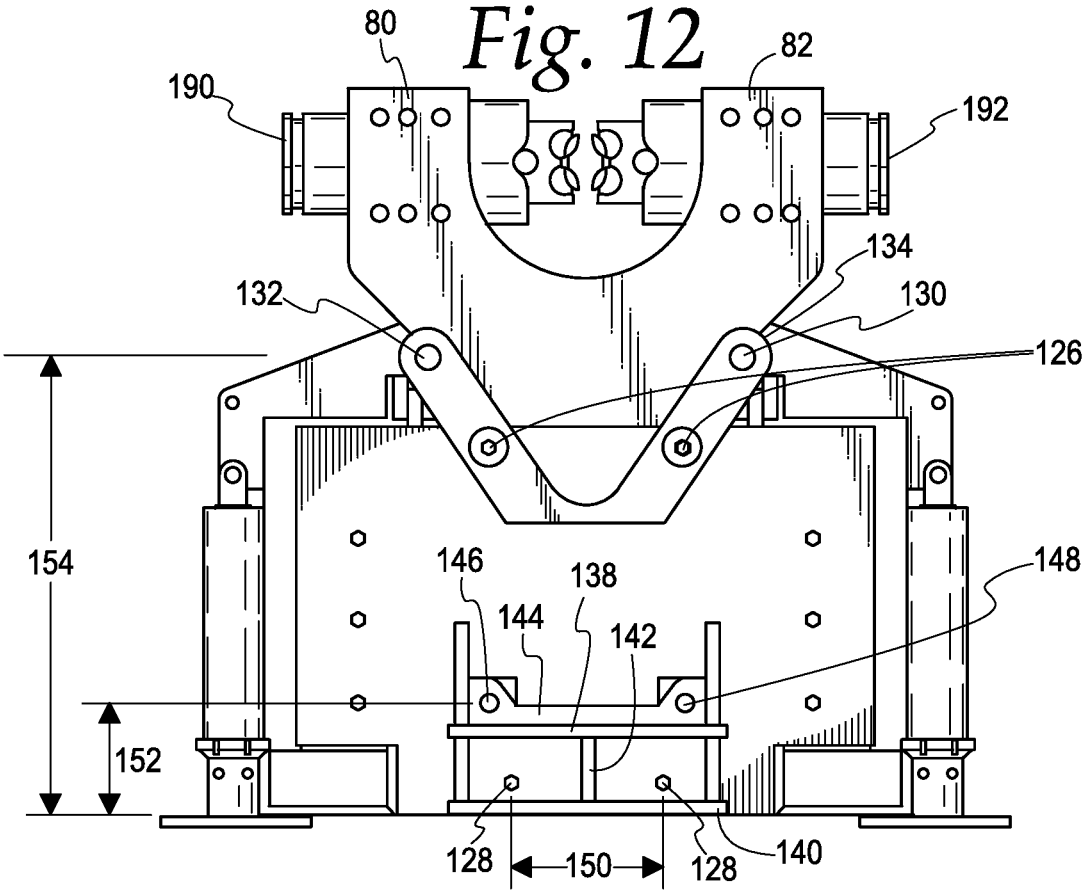

PORTABLE BUCKING FRAME

CROSS-REFERENCE TO RELATED APPLICATION

This application claims the benefit of U.S. Provisional Patent Application No. 62/668,583 filed May 8, 2018, which is hereby incorporated by reference in its entirety herein.

BACKGROUND OF THE INVENTION

I. Field of the Invention

The present disclosure relates generally to tools for rig drilling equipment in the field of oil and gas wells, and more specifically to a portable bucking frame for making or breaking tubular connections.

II. Description of the Prior Art

Tubular joint integrity is of utmost importance in wells since a leak in any one joint of a high-pressure tubing string can necessitate shutting down of the well and removing and replacing the complete string. Such removal and replacement are an expensive proposition. In other situations, mere leakage in tubing joints can cause loss of the entire well for extended periods of time or even indefinitely.

Power tools for making up and/or breaking out tubular connections have been in general use in the field for a number of years. The term bucking unit is generally applied to makeup machines used to install couplings on pipe usually in a pipe mill or a threading facility. These units are used to make up and buck up couplings on pipe lying in the horizontal position. The bucking unit assembly includes a drive unit which imparts a rotary torque to a coupling and the backup unit which holds the end of the pipe in position and provides the necessary backup torque. The term power tongs is generally applied to makeup machines used to connect joints as successive joints are added and the assembled pipe is lowered into the well. Rotary power for making up the threaded connection is provided by the power tongs. A backup device is normally mounted below the power tongs to hold the adjacent pipe stationary as the power tongs are actuated.

The use of properly sized power tongs on a bucking unit for making or breaking pipe connections has numerous difficulties. Indeed, a bucking unit is generally very heavy, has a large size, and is difficult to transport to different locations. Additionally, a power tong of a specific manufacturer has specific mounting points, which may be bolting holes or brackets, and different power tongs from different manufacturers or different power tongs from the same manufacturer may have different mounting points. Accordingly, a bucking frame is generally configured to receive only one specific type of power tong.

Furthermore, both the drive unit and the backup unit employ gripping devices or jaws which move inwardly to contact the relatively smooth surface of the pipe or coupling and impart sufficient forces thereto to transmit torque from the driving means to the members being threadedly joined. As such a proper fit and positioning of the pipes is essential to ensure there is no damage and a proper make up.

The present disclosure overcomes the disadvantages of presently available bucking units. Accordingly, it is a general object of this disclosure to provide an improved bucking unit.

It is another general object of the present disclosure to provide a portable bucking frame.

The present disclosure has a pair of adjustable back-up jaws moveable along the channels of the bucking frame. The present disclosure also has a plurality of feet for adjusting the height of the bucking frame for aligning the pipes to be made. Accordingly, it is another general object of the present disclosure to provide an adjustable bucking frame.

The present disclosure has an adapter plate that allows any of the currently commercially available power tongs to be mounted on the adapter plate. It is therefore a more specific object of the present disclosure to receive versatile power tongs for making or breaking pipe connections.

The present disclosure has an adapter plate with mounting points corresponding to the mounting points of commercially available power tongs. As such, any power tong may be mounted on or attach to the adapter plate. In it therefore another more specific object of the present disclosure to receive any commercially available power tong to make up or break up a pipe connection.

These and other objects, features and advantages of this disclosure will be clearly understood through a consideration of the following detailed description.

SUMMARY OF THE INVENTION

According to an embodiment of the present disclosure, there is provided a portable bucking frame for making and breaking tubular connections including a base for supporting the frame on a support surface and a pair of back-up jaws movably mounted to the base for receiving the tubular member. An adapter plate is mounted on the front end of the base and is configured to receive a plurality of power tongs.

According to an embodiment of the present disclosure there is also provided a bucking frame including a base to support the frame on a surface and a back-up jaw unit mounted on the base that is horizontally adjustable to position a tubular thereon. An adapter plate is mounted on the front end of the base and is adaptable to receive multiple power tongs.

According to an embodiment of the present disclosure there is also provided a portable bucking frame for making and breaking tubular connections including an adjustable base for supporting the frame at a height above an underlying support surface and a back-up jaw unit movably mounted to the base that includes a pair of adjustable jaws for receiving and positioning a tubular thereon. An adapter plate is mounted on the front end of the base and includes a base plate having multiple hole configurations to accommodate a plurality of power tongs for making and breaking tubular connections.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which:

FIG. 11 is a right frontal perspective view of a portable bucking frame of FIG. 1 with power tong mounting plates.

FIG. 12 is a front view of the portable bucking frame of FIG. 11.

DESCRIPTION OF THE PREFERRED EMBODIMENTS

Figure 1:
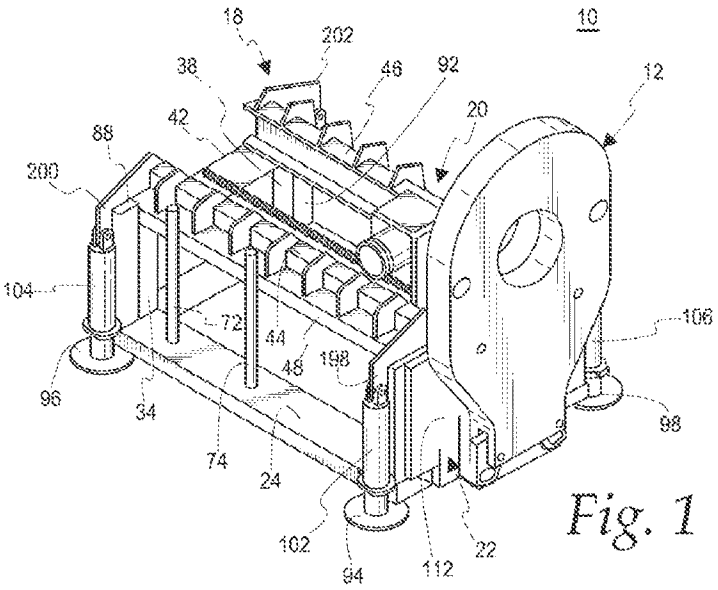
FIG. 1 is a left frontal perspective view of a portable bucking frame mounted with a power tong according to the principles of an embodiment of the present disclosure.

One or more embodiments of the subject disclosure will now be described with the aid of numerous drawings. Unless otherwise indicated, use of specific terms will be understood to include multiple versions and forms thereof.

A power tong is a large-capacity, self-locking wrench used for applying torque, and gripping drill string components, and is an important tool in the oil and gas industry. A power tong, such as a casing power tong, provides a driving mechanism to a bucking unit. For example, a power tong makes a rotating motion when breaking out, or making up casings, tubings, drill pipes, and other pipes. This will be referred as make up or break out pipe connections in the description below. The make up torque of a power tong varies with different casing sizes, grades, metallurgies, weights, and the thread compound friction factors being utilized. A power tong generally is hydraulically powered.

Referring now to the Figures, and in general to FIGS. 1-12, an exemplary embodiment of a portable bucking frame 10 mounted with a power tong 12 is illustrated. FIGS. 13-17 illustrate a further exemplary embodiment of the adapter plate 14 of the portable bucking frame 10 for mounting another power tong 16.

In FIGS. 1-12, the portable bucking frame 10 includes a base 18, a back-up jaw unit 20 mounted on the base 18, and an adapter plate 22 mounted on the front end of the base 18. The back-up jaw unit 20 is moveable horizontally in relation to the base 18 to move a pipe or a pipe joint to a desired location. A power tong 12 may be mounted on the adapter plate 22 for securely locking an end of a tubular member, pipe or a pipe joint, applying torque, and rotating the pipe or the pipe joint to make or break a pipe connection. In an example of making up a pipe connection, the back-up jaw unit 20 securely retains an end of a first pipe, and power tong 12 retains an end of a second pipe, the power tong 12 applies torque and rotates the second pipe with respect to the first pipe to make up a pipe connection. In an example of breaking out a pipe connection, the back-up jaw 20 securely retains a first end of a pipe joint, and a power tong 12 retains the second end of the pipe joint and applies torque and rotates the second end of the pipe joint with respect to the first end of the pipe joint to break out a pipe connection. Therefore, the portable bucking frame 10 together with the power tong 12 mounted on the adapter plate 22 makes up or breaks out a pipe connection.

The base 18 supports the back-up jaw unit 20 and the adapter plate 22. The base 18 is configured to stabilize the bucking frame 10 when the adapter plate 22 is mounted with the power tong 12, and when each of the power tong 12 and the back-up jaw unit 20 is mounted with a pipe or retains an end of a pipe joint.

For example, the bucking frame 10 has a small stature, such as 94" length×68" height×58" width. The bucking frame 10 may have larger or smaller dimensions to accommodate the dimension and specification of the pipes to be made up or broken out. In one example, the total weight of the bucking frame 10 is about 4,500 lbs. The bucking frame 10 having a small stature is convenient to be transported to different locations for making up or breaking out a pipe connection, for example, in a pick-up truck.

In the embodiment of FIGS. 1-12, the base 18 includes a left bottom beam 24, a right bottom beam 26, a front bottom beam 28 and a rear bottom beam 30 to form a horizontal contact base with the ground or with a support surface of the bucking frame 10. The left bottom beam 24, right bottom beam 26, front bottom beam 28 and rear bottom beam 30 may be made of wood or metal. The left bottom beam 24 is substantially parallel to the right bottom beam 26. The front bottom beam 28 may be substantially parallel to the rear bottom beam 30. Each of the front bottom beam 28 and the rear bottom beam 30 is placed between and connected with the left bottom beam 24 and the right bottom beam 26. For example, the two ends of the front beam 28 are perpendicularly connected, for example by welding or bolting, to a side of each of the left bottom beam 24 and the right bottom beam 26 close to the front ends of respective left bottom beam 24 and right bottom beam 26. The interconnected beams 24, 26, 28 and 30 may have a rectangular shape. Each of the two ends of the rear bottom beam 30 side connected, for example by welding or bolting, to a side surface close to the rear ends of respective left bottom beam 24 and the right bottom beam 26. Unless specified otherwise in the description below, an element of the bucking frame 10 may be connected with another element by welding or bolting. In another example, the contact base may be replaced with a flat plate, such as a metal plate or a wood plate.

The base 18 may include a plurality of vertical beams extended upwardly from the top surfaces of the left and right bottom beams 24 and 26. For example, a front vertical beam 32 has a first end connected to the top surface close to the front end of the left bottom beam 24, and a rear vertical beam 34 has a first end connected to the top surface close to the rear end of the left bottom beam 24. Both vertical beams 32 and 34 extend vertically from their respective first end to a second end. Similarly, a front vertical beam 36 (FIG. 5) has a first end connected to the top surface close to the front end of the right bottom beam 26, and a rear vertical beam 38 has a first end connected to the top surface close to the rear end of the right bottom beam 26. Both vertical beams 36 and 30 extend vertically from their respective first ends to second ends.

The base 18 may include a top front horizontal beam 40 and a top rear horizontal beam 42. The bottom surface close to the left end of the top front horizontal beam 40 is connected with the second end of the vertical beam 32, and the bottom surface close to the right end of the top front horizontal beam 40 is connected with the second end of the vertical beam 36. The bottom surface close to the left end of the top font horizontal beam 42 is connected with the second end of the vertical beam 34, and the bottom surface close to the right end of the top front horizontal beam 42 is connected with the second end of the vertical beam 38.

A left C-shaped channel 44 and a right C-shaped channel 46 are placed on the top front horizontal beam 40 and top rear horizontal beam 42. The front end and rear end of the C-shaped channel 44 are connected with top surfaces close to the respective left ends of the top front horizontal beam 40 and top rear horizontal beam 42. The front end and rear end of the right C-shaped channel 46 are connected with top surfaces close to the respective right C-shaped channel 46 are connected with top surfaces close to the respective right ends of the top front horizontal beam 40 and top rear horizontal beam 42. The left C-shaped channel 44 and right C-shaped channel 46 are substantially parallel to each other. In some examples, the left C-sha[ped channel 44 and right C-shaped channel 46 are parallel to the left beam 24 and the right beam 26 respectively.

Figure 2:
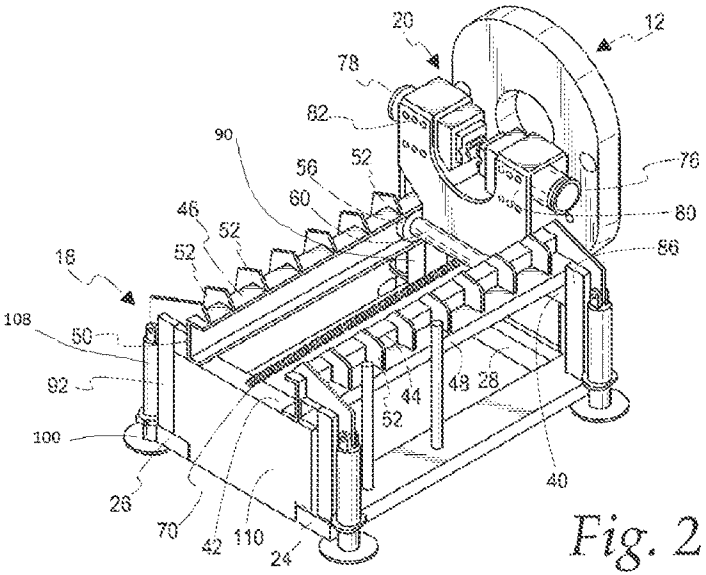
FIG. 2 is a left rear perspective view of the portable bucking frame of FIG. 1.
Figure 3:
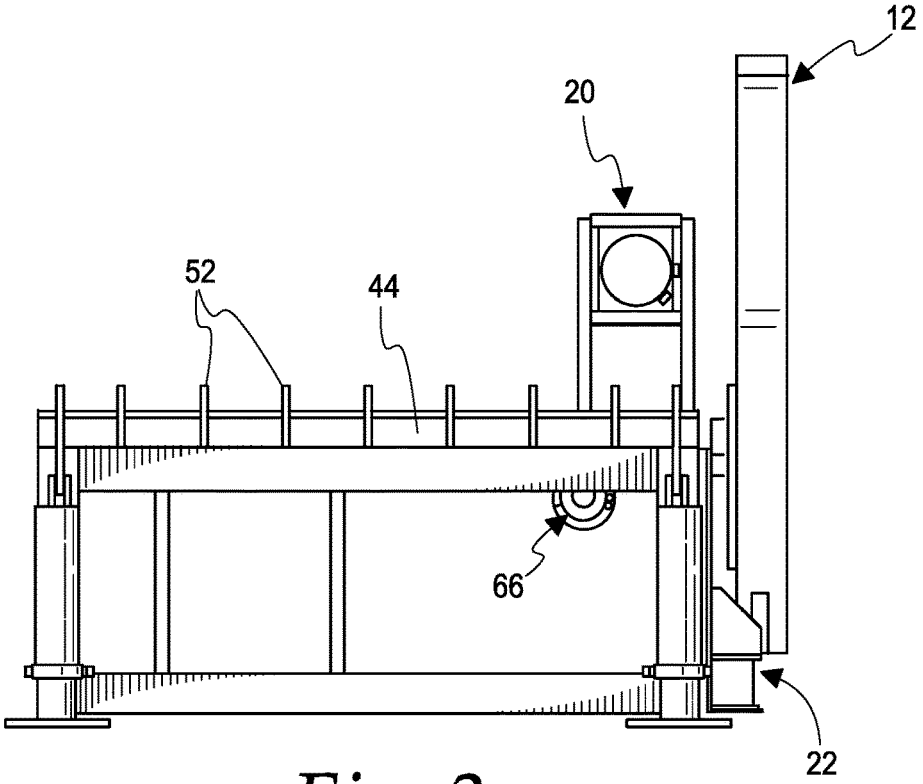
FIG. 3 is a left side view of the portable bucking frame of FIG. 1.
Figure 4:
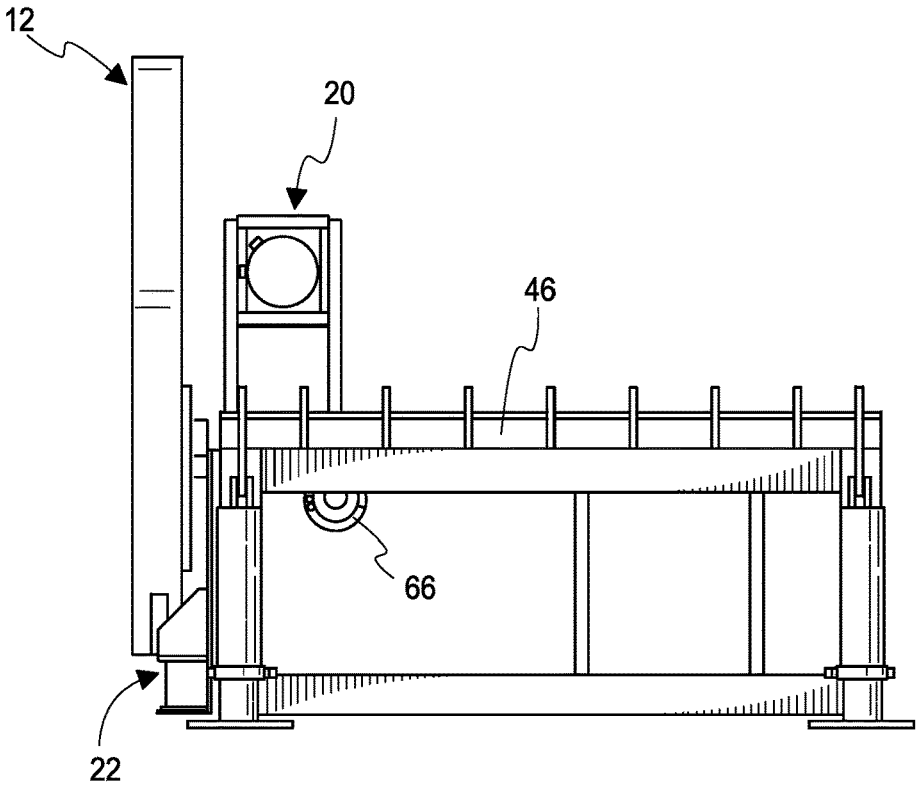
FIG. 4 is a right side view of the portable bucking frame of FIG. 1.

As illustrated in FIG. 2, the left and right C-shaped channels 44 and 46 each define a slot. As illustrated in FIG. 2, the slots face each other, and each slot receives a roller of the back-up jaw unit 20 to be described below.

In some examples, the base 18 may include a left outer beam 48 and a right outer beam 50 (FIG. 2). The left outer beam 48 may be connected on the outer surface of the left C-shaped channel 44 and on the top surface of the two left ends of the top front horizontal beam 40 and top rear horizontal beam 42. Similarly, the right outer beam 50 may be connected to the outer surface of the right C-shaped channel 44 and the top surface of the two right ends of the top front horizontal beam 40 and top rear horizontal beam 42. The left outer beam 48 and the right outer beam 50 increase the structural integrity of the left C-shaped channel 44 and the right C-shaped channel 46, respectively.

As illustrated in FIGS. 1-12, to further enhance the structural integrity of the left and right C-shaped channel 44 and 46, a plurality of structural reinforcement elements 52 may be mounted on the top surfaces of the left beam 48 and the right beam 50 and on the outer surfaces of the left and right C-shaped channel 44 and 46. For example, each of the left and right C-shaped channel 44 and 46 may include seven structural reinforcement elements 52.

A back-up jaw unit 20 includes a jaw base 54 within a frame. The jaw base 54 may include two rollers 56 and 58 (FIG. 5), and a horizontal beam 60 that connects with the two rollers 56 and 58 and serves as an axis of the rollers 56 and 58. The roller 56 is received in the slot 62 defined by the left C-shaped channel 44 and the roller 58 is received in the slot 64 defined by the right C-shaped channel 46. The rollers 56 and 58 are rotatably movable within the respective slots 62 and 64. The rollers 56 and 58 may be inserted in the slots 62 and 64 from the rear ends of the left and right C-shaped channel 44 and 46. In some embodiments, the rollers 56 and 58 may not be rotatable but are slidable within the C-shaped channels 44 and 46.

A driving mechanism may be used to horizontally drive the back-up jaw unit 20 with the C-shaped channels 44 and 46. The driving mechanism may include a motor 66 (FIG. 8), a gear 68, and a chain 70. The motor 66 may be a hydraulic motor. The motor is securely mounted on the bottom surface of the horizontal beam 60. The gear 68 is mounted on the motor 66. The chain 70 is mounted between the top front horizontal beam 40 and the top rear horizontal beam 42. The gear 68 engages the chain 70. When the motor 66 is actuated by hydraulic pressure, the motor 66 drives the gear 68 to rotate clockwise or counter-clockwise. The rotation of the gear 68 makes the horizontal beam 60, the axis of the rollers 56 and 58, move horizontally. For example, clockwise rotation of the gear 68 causes the beam 60 to move forward, and counter-clockwise rotation of the gear 68 causes the beam to move backward. The movement of the beam 60 in turn causes rollers 56 and 58 to rotate or slide within the slots 62 and 64. As such, the motor 66 causes the back-up jaw unit 20 to move forward or backward along the C-shaped channels 44 and 46.

In some embodiments, a control stand may be mounted on a side of the bucking frame 10, such as on the two vertical beams 72 and 74 (FIGS. 1 and 2) on the left side of the bucking frame 10. The controller on the stand controls the hydraulic pressure of the motor 66 and controls the movements of the back-up jaw unit 20.

Other driving mechanisms may also be used to drive the back-up jaw unit 20 backwards and forwards. For example, a hydraulic ram may be used to push and pull the horizontal beam 60 and thus cause the movements of the back-up jaw unit 20.

The back-up jaw frame may be configured to receive a pair of the back-up jaws 76 and 78 (FIG. 2). The back-up jaw frame may be mounted on the top surface of the horizontal beam 60. The back-up jaw frame has a left housing 80 (FIG. 2) and a right housing 82 (FIG. 2) for receiving a pair of back-up jaws 76 and 78, respectively.

Each of the housings 80 and 82 may include a plurality of through holes 84, for example, three pairs of through holes 84, or six holes 84 on each of the front side and rear side of each housing 80 or 82. Each pair of through holes 84 may receive a bolt for locking a jaw at one position. The position of the jaws 76 and 78 may be selected based on the radius of a pipe, a pipe joint, a collar, or accessory for the pipe, so that the pipe can be securely retained between the pair of jaws 76 and 78. The position of each jaw 76 or 78 may be further adjusted independently by a hydraulic actuator (not shown) for the jaw to secure the pipe or the pipe joint. The jaws 76 and 78 may each have a die for retaining the pipe or the pipe joint. Additionally, the back and forth movements of the back-up jaw unit 20 along the C-shaped channels 44 and 46 also allow the back-up jaw unit 20 to securely retain a pipe or an end of a pipe joint at any position along the C-shaped channels 44 and 46. The position adjustability of the back-up jaw unit 20 and the individual jaws 76 and 78 provide a flexibility in pipe connection making up and breaking out processes. As the adjustable back-up jaw unit 20 may be moveably positioned along the C-shaped channels 44 and 46, a pipe or a pipe joint does not need to be placed on an exact position to properly make up or break out a pipe connection. Therefore, the adjustable back-up jaw unit 20 makes the process of making up or breaking out a pipe connection easier to an operator of the bucking frame 10.

In some embodiments, two vertical beams 86 and 88 are mounted on the top surfaces close to the respective front end and rear end and close to the outer side edge of the bottom beam 24. Similarly, two vertical beams 90 and 92 are mounted on the top surfaces close to the respective front end and rear end and close to the outer side edge of the bottom beam 26. The four vertical beams 86, 88, 90 and 92 may contact the vertical beams 32, 34, 36 and 38 respectively to enhance the integrity of the bucking frame 10.

The base 18 may include a plurality of adjustable feet for adjusting the height of the bucking frame 10. In the embodiment of FIGS. 1-12, the base 18 includes four adjustable feet 94, 96, 98 and 100. Hydraulic rams 102 and 104 are mounted on the left sides of the vertical beams, 86 and 88, respectively; and hydraulic rams 106 and 108 are mounted on the right sides of the vertical beams, 90 and 92, respectively. Each of the adjustable feet 94, 96, 98 and 100 may be an end of a piston of a respective hydraulic ram 102, 104, 106 and 108, with an extended flat contact area for contacting the ground or support surface to support. The extended flat contact area of each of the four adjustable feet 94, 96, 98 and 100 keeps stability of the bucking frame 10 during pipe connection making up and breaking out processes. The contact area may be an extended flat circular area illustrated in the embodiment of FIGS. 1-2 and 7-12.

As such, by actuating the hydraulic rams 102, 104, 106 and 108, the height of the feet 94, 96, 98 and 100 may be adjusted individually or collectively. For example, one or more of the height of the feet 94, 96, 98 and 100 may be adjusted to align the ends of the pipes when a pipe connection is made. In some embodiments, each of the hydraulic rams 102, 104, 106 and 108 may be adjusted to raise or lower the bucking frame 10 by 12".

The hydraulic rams 102, 104, 106 and 108 may also be mounted at the bottom surfaces of the horizontal contact base of the bucking frame 10, for example, at the bottom surfaces close to the front and rear ends of the left bottom beam 102 and right bottom beam 104. In this case, the vertical beams 86, 88, 90 and 92 are not necessary to mount the hydraulic rams 102, 104, 106 and 108 and therefore may be omitted. The height of the feet 94, 96, 98 and 100 in this case may also be similarly adjusted as described above by actuating one or more of the hydraulic rams 102,104,106 and 108.

Figure 5:
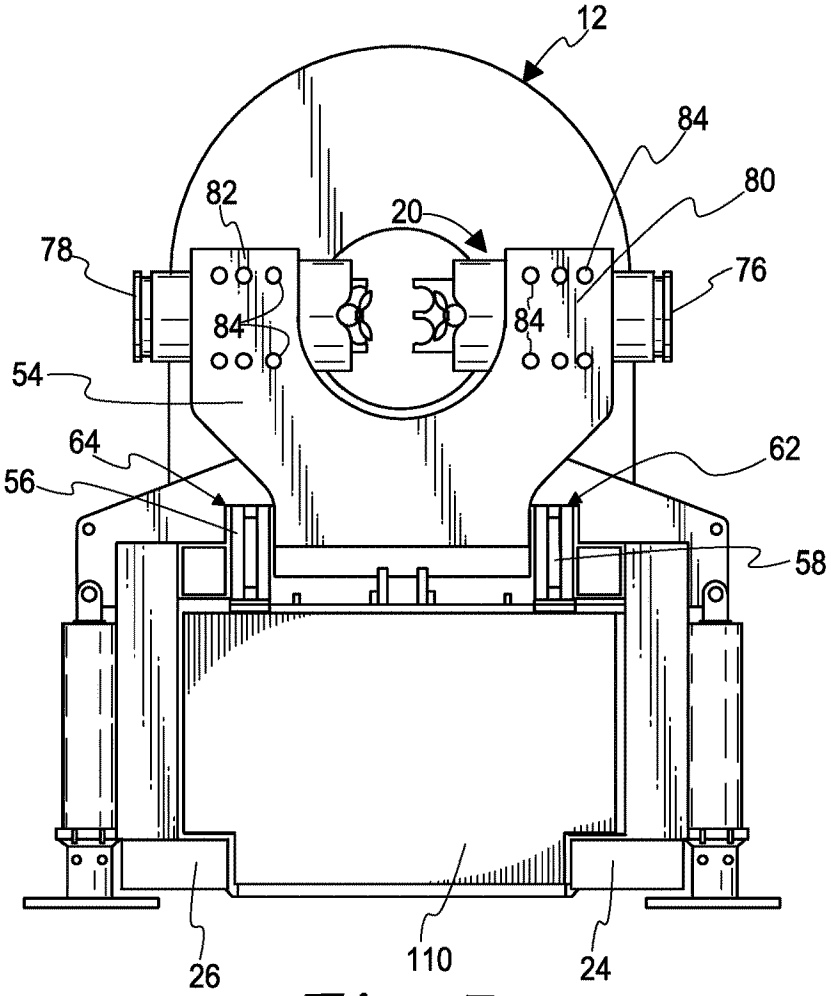
FIG. 5 is a rear view of the portable bucking frame of FIG. 1.
Figure 7:
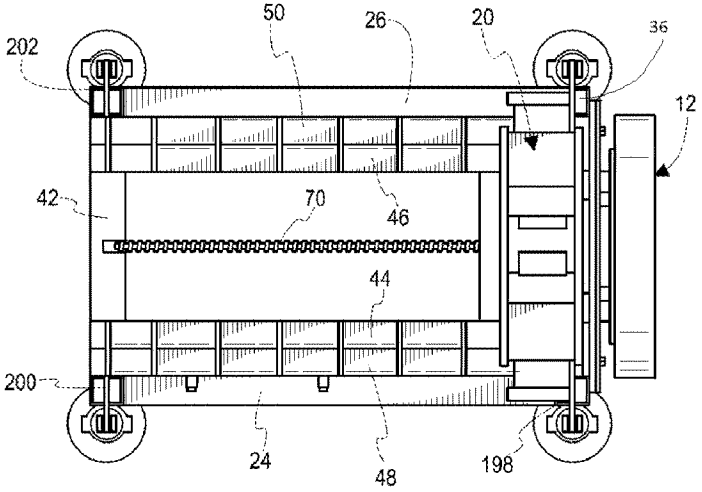
FIG. 7 is a top view of the portable bucking frame of FIG. 1.
Figure 8:
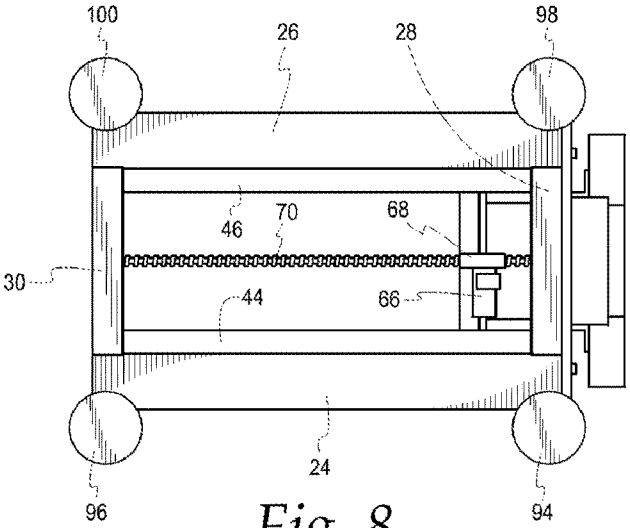
FIG. 8 is a bottom view of the portable bucking frame of FIG. 1.

In some embodiments, the base 18 may include a rear plate 110 as illustrated in FIG. 5. The rear plate 110 may connect the outer surfaces of rear vertical beams 34 and 38, the bottom rear horizontal beam 30, and the top rear horizontal beam 42, for reinforcing the structural integrity of the base 18.

The bucking frame 10 also includes an adapter plate 22 for receiving the power tong 12. In the embodiments of FIGS. 1-12, the adapter plate 22 is mounted in front of the base 18 via a base plate 112. For example, the base plate 112 of the adapter plate 22 has three pairs of the bolting holes, 114 and 116, 118 and 120, and 122 and 124, for bolting the adapter plate 22 on the front surfaces of the left and right vertical beams 32 and 36. The vertical beam 32 may have three threaded bolting holes at positions corresponding to the three holes 114, 118 and 122, and the vertical beam 36 may have three threaded bolting holes at positions corresponding to 116, 120 and 124, when the base plate 112 is mounted on the vertical beams 32 and 36. Each of the three pair of threaded bolting holes on the base plate 112 and its corresponding threaded bolting hole on the vertical beams 32 and 36 may engage a threaded bolt for mounting the adapter plate 22 on the base 18. Each of threaded bolts may be further secured with a nut on the front surface of the base plate 112 as illustrated in FIGS. 1, 6 and 9-12.

In some embodiments, each of the vertical beams 32 and 36 may have three bolting through holes penetrating the front side and rear side of the vertical beams 32 and 36. The three bolting through holes on the vertical beam 32 in positions correspond with the three bolting holes 114, 118, and 122, and the three through holes on the vertical beam 36 correspond 116, 120, and 124. Each of the three pair of threaded bolting holes on the base plate 112 and its corresponding bolting through hole on the vertical beams 32 and 36 may engage a bolt, which may be threaded or non-threaded. Each of six bolts may be secured with a nut on the front surface of the base plate 112 and the rear surfaces of the vertical beams 32 and 36.

The number of the bolting holes on the base plate 112 may be varied, as long as the bucking frame 10 is stable when the adapter plate 22 is mounted with the power tong 12 carrying a pipe during the pipe connection making up and breaking out processes. The vertical beams 32 and 36 have bolting holes at positions corresponding to the bolting holes on the adapter plate 22 when the adapter plate 22 is mounted on the vertical beams 32 and 36. For example, the based plate 112 may have 2, 4, 5 or more pairs of bolting holes, with each of the vertical beams 32 and 36 have 2, 4, 5 or more corresponding bolting holes.

In some embodiments, the positions of the bolting holes on the base plate 112 may be varied. For example, the base plate 112 is mounted on the front surfaces of the vertical beams 86 and 90, which provide bolting holes at positions corresponding with the base plate 112 when the base plate 112 is mounted on the vertical beams 86 and 90.

Figure 9:
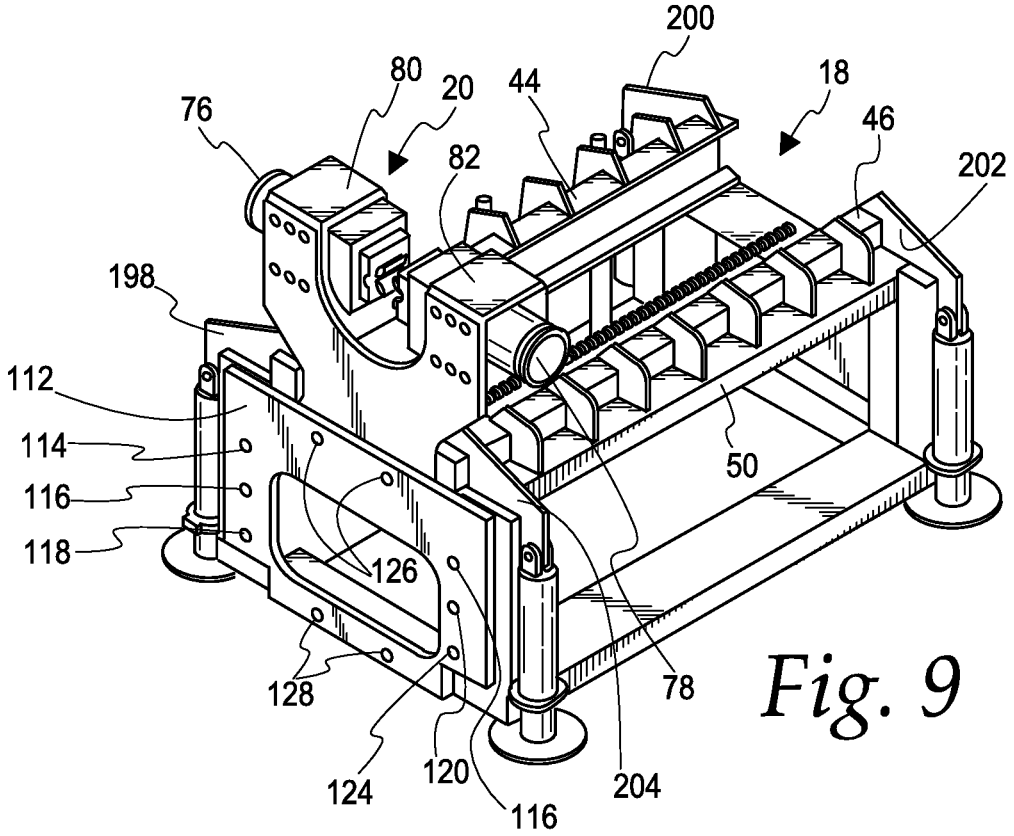
FIG. 9 is a right frontal perspective view of a portable bucking frame of FIG. 1 without the power tong mounting plates.
Figure 10:
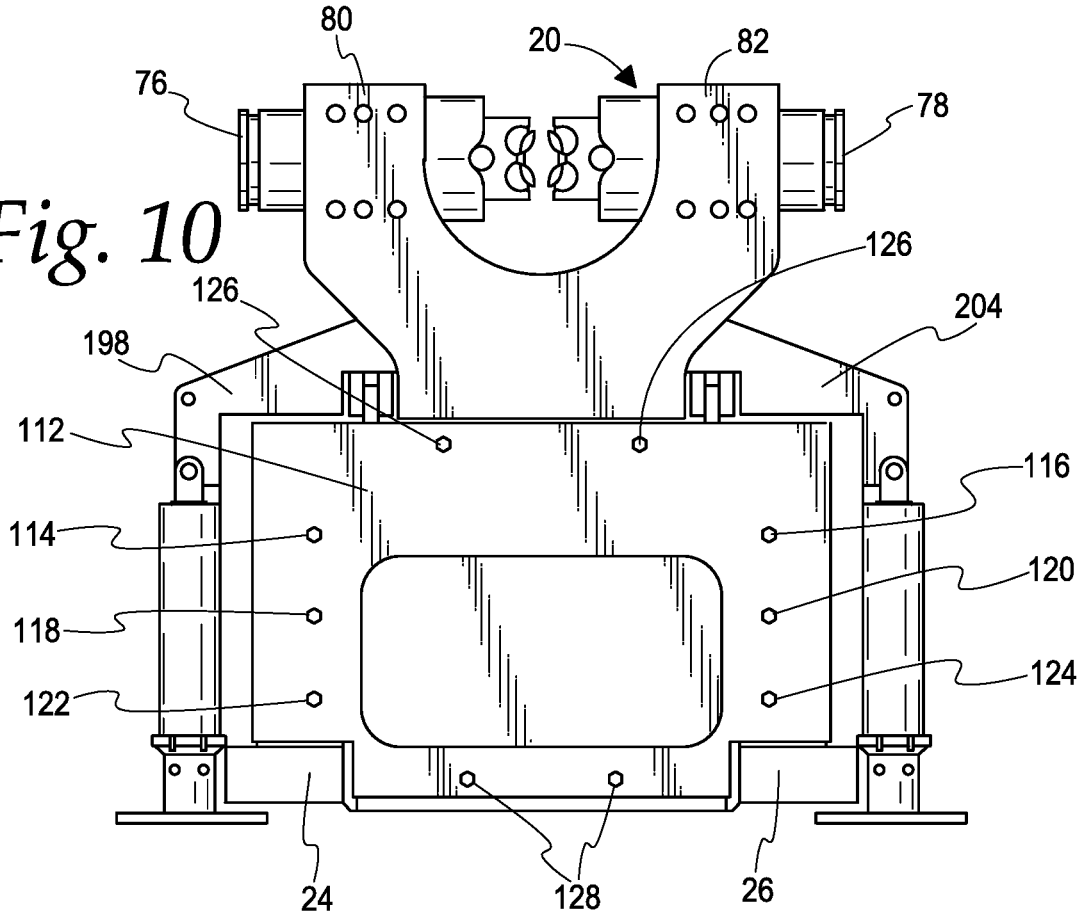
FIG. 10 is a front view of the portable bucking frame of FIG. 9 including an alternate embodiment of the adapter plate.
Figure 14:
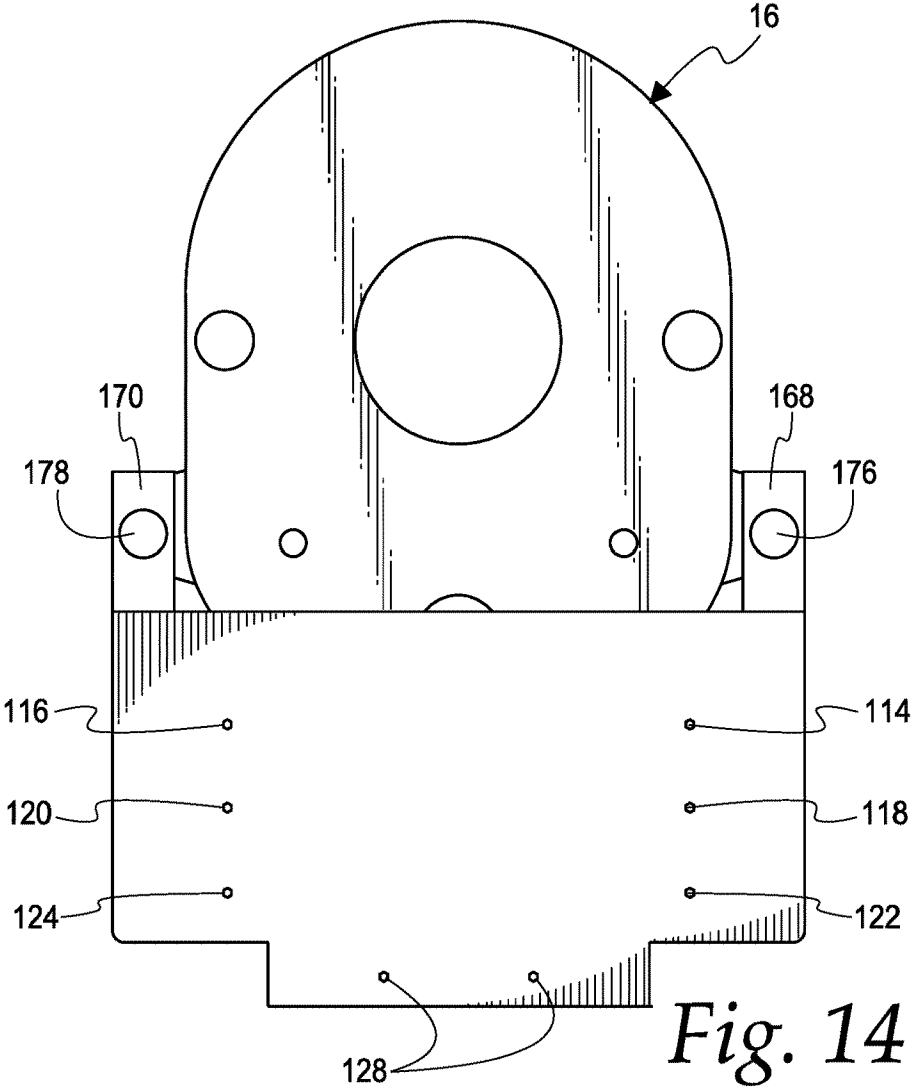
FIG. 14 is rear view of the adapter plate of FIG. 13.
Figure 13:
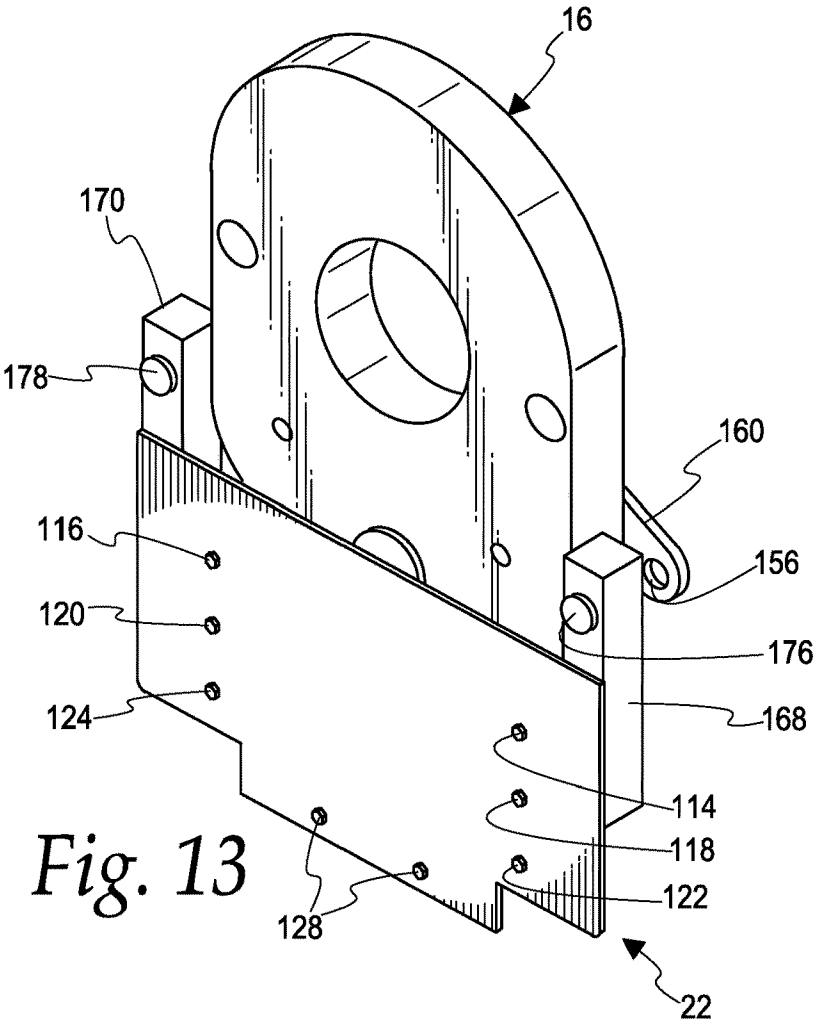
FIG. 13 is a rear perspective view of an alternate embodiment of the adapter plate for mounting a power tong on the portable bucking frame of FIG. 1.

In the embodiments of FIGS. 9 and 10, the base plate 112 may be further mounted on the front surface of the front top beam 40 and the front bottom beam 28 via one or more of the bolting hole 126 and 128, respectively. In FIG. 9, the base plate 112 may include a carve-out portion above the top surface of the front bottom beam 28 but below the front top beam 40. In FIG. 10, the base plate 112 may not include the carve-out portion.

As illustrated in the embodiments of FIGS. 11 and 12, the base plate 112 may receive a V-shaped support structure 130 for mounting on the base plate 112 via the bolting holes 126. The V-shaped support structure 130 includes two bolting holes 132 and 134 close to the two respective ends of the V-shaped support structure 130. The two bolting holes 132 and 134 correspond to two mounting points of the power tong 12 when the power tong is mounted on the bucking frame 10.

Figure 6:
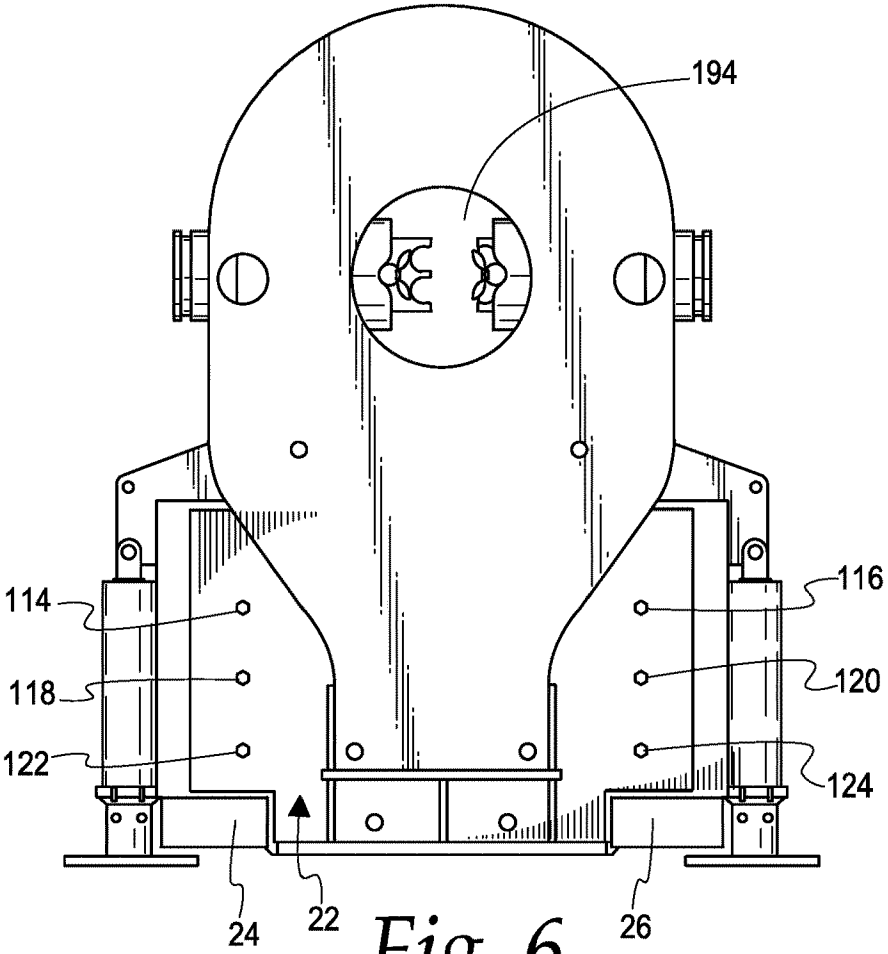
FIG. 6 is a front view of the portable bucking frame of FIG. 1.

In the embodiments of FIGS. 1, 6, 11 and 12, the adapter plate 22 includes an additional support 136 close to the bottom of base plate 112 for supporting the power tong 12. As illustrated in FIGS. 6, 11 and 12, the support 136 includes two horizontal plates 138 and 140 connecting the bottom front surface of the adapter plate 22 and with the top and bottom surface of the two parallel plates 138 and 140.

A vertical plate 144 (FIGS. 11 and 12) is connected with the top surface of the top horizontal plate 138. The vertical plate 144 has a pair of bolting holes 146 and 148 that correspond with two bottom mounting points (bolting holes) of a power tong 12. The power tong 12 may be mounted on the adapter plate 22 by bolting the power tong 12 to the adapter plate 22 via the bolting holes 132 and 134, and 146 and 148. For example, the mounting points of the power tong 12 and the corresponding bolting holes 132 and 134, 146 and 148 of the adapter plate 22 threadedly engage a threaded bolt, and a first nut locks the bolt on the front surface of the power tong 12, and a second nut locks the bolt of the rear surface of the adapter plate 22. In an embodiment illustrated in FIG. 12, the distance 150 between two bolting holes 128 is about 13", the distance 152 between the bolting holes 128 and the ground is 7.3", and the distance 154 between the bolting holes,132 and 134, and the ground is about 30".

Two rollers may be placed on the respective left and right sides of the vertical plate 142 and between the two horizontal plates 138 and 140. The two rollers support the power tong 12 and transfer the force or torque that the power tong 12 applies to the pipe or pipe joint to the electrical or hydraulic load cell mounted on the brackets. As such, the force or torque applied to the pipe or the end of the pipe joint may be monitored for the duration of the making up or breaking out of a pipe connection.

As illustrated in the embodiments of FIGS. 13-17, a power tong 16 may include a plurality of brackets mounting on the power tong 16. Different models of the power tong 16 may have different number of brackets, such as 3-4 brackets mounted on the power tong 16. Each bracket has a bolting hole. The bolting holes 156 and 158 of the respective brackets 160 and 162 may be bolted on the adapter plate 22, or on the accessories of the adapter plate 22 with the corresponding bolting holes on the adapter plate 22 or on the accessories. In some embodiments, a bracket has a load cell anchor, and a hydraulic or electric load cell may attach to the load cell anchor for monitoring the force or torque that the power tong 12 or 16 applies to the pipes or pipe joints.

Figure 15:
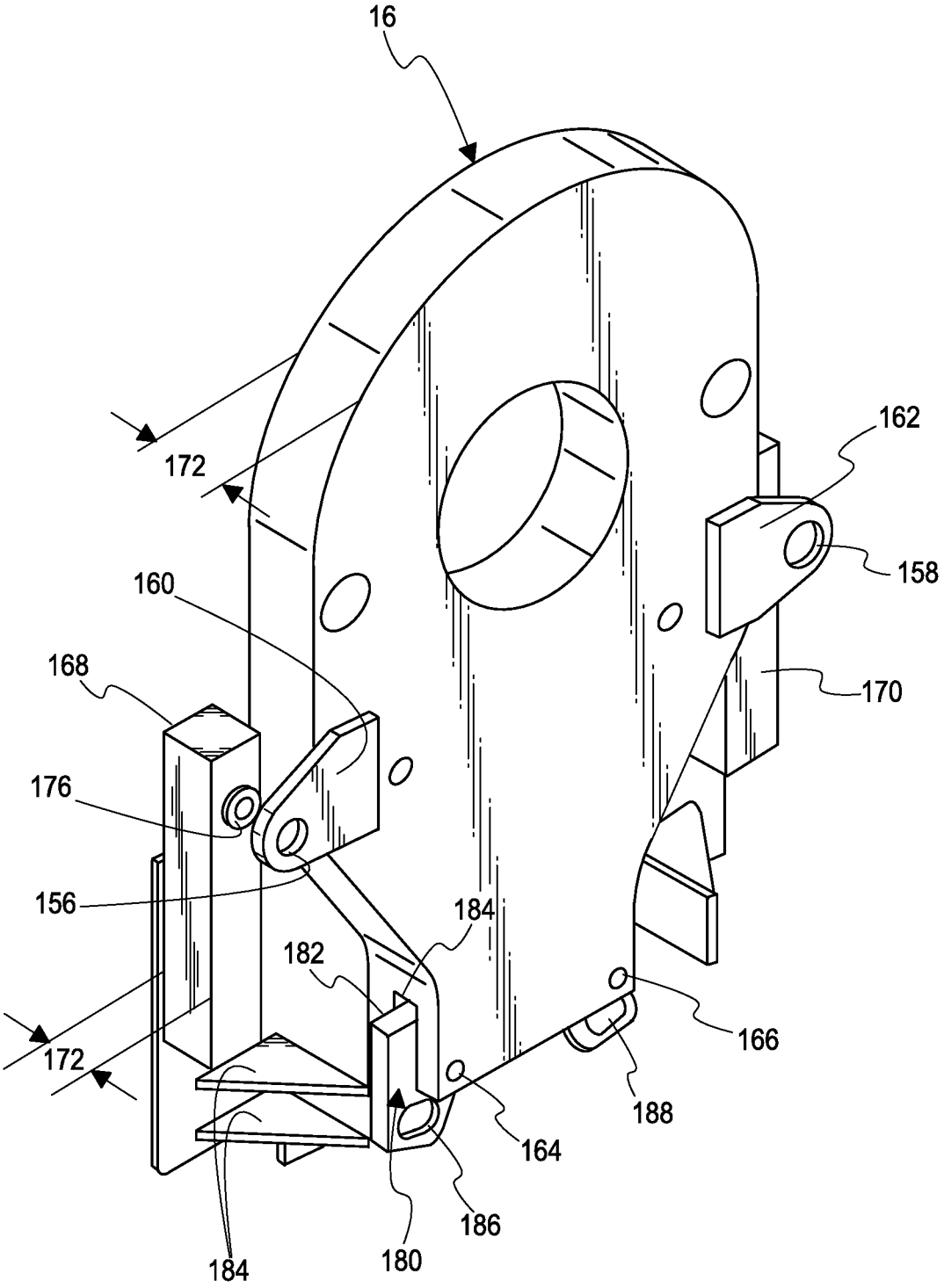
FIG. 15 is a frontal perspective view of the adapter plate of FIG. 13.

In this regard, in the embodiment of FIG. 15, a power tong 16 has two bottom bolting holes 164 and 166 and two brackets 160 and 162 having bolting holes 156 and 158, respectively. The adapter plate 22 may further include accessories for example two vertical beams 168 and 170 that are securely connected to the front surface of the adapter plate 22 close to the two side edges of the adapter plate 22. The thickness 172 of the vertical beams 168 and 170 may be substantially the same as the thickness 174 of the power tong 16. Each of the vertical beam 168 and 170 has a bolting hole, or a bolting through holes 176 or 178, corresponding to the bolting holes 156 and 158 on the brackets of the power tong 16, respectively. In FIG. 15, the power tong 16 is mounted on the adapter plate 22 via bolts and nuts as described above by engaging the two bottom bolting holes 146 and 148 and two corresponding bottom bolting holes 164 and 166 of the power tong 16, and by engaging the two bolting holes 176 and 178 with the bolting holes 156 and 158 on the brackets in the middle side portion of power tong 16.

Figure 17:
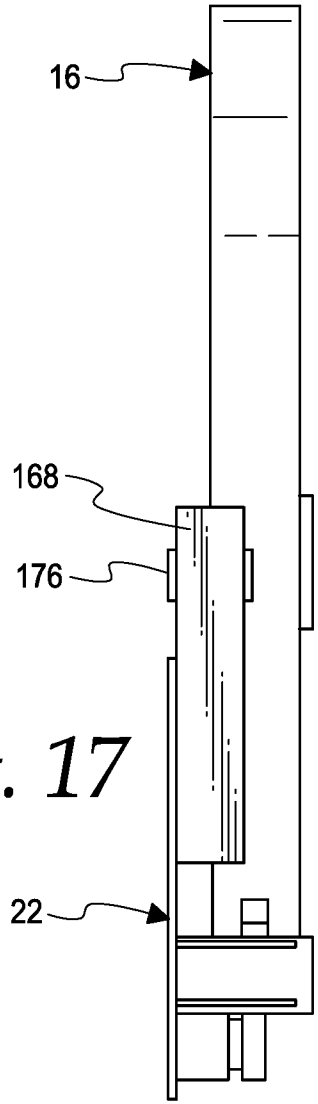
FIG. 17 is a left side view of the adapter plate of FIG. 13.
Figure 16:
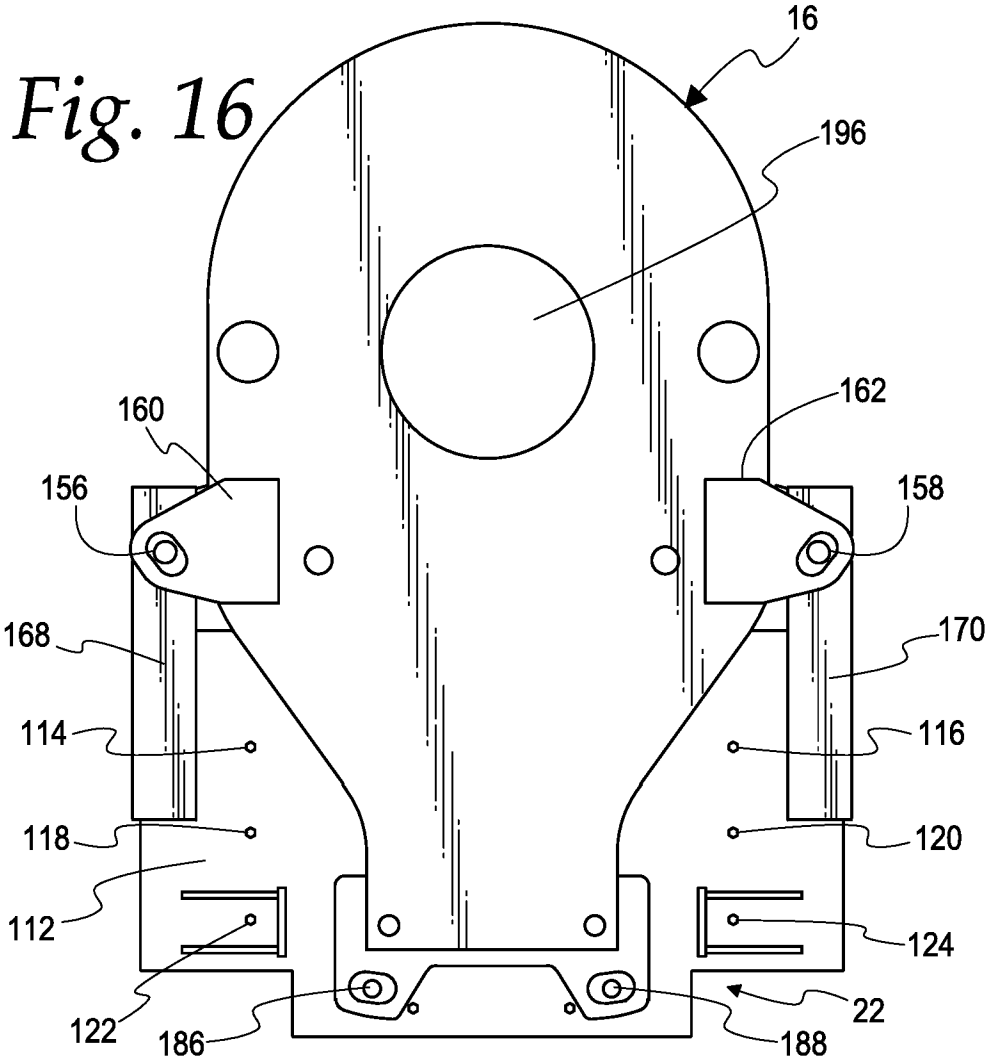
FIG. 16 is a front view of the adapter plate of FIG. 13.

In the embodiment of FIGS. 15-17, the adapter plate 22 includes a support 180. The support 180 has a bottom portion horizontally connected to the bottom front surface of the adapter plate 22, extends horizontally away from the bottom front surface of the adapter plate 22, and then extends upwardly in a vertical plate 182 parallel to the front surface of the adapter plate 22. The plate 182 may be inserted into the middle bottom slot 184 of the power tong 16. The plate 182 has the two bolting holes (not shown) that correspond with the bottom bolting holes 164 and 166 of the power tong 16 when the middle bottom slot of the power tong 12 or 16 engages the plate 182. Each of the bolting holes 164 and 166 and their corresponding bolting hole 146 and 148 on plate 182 may engage a bolt and locked by a nut. As illustrated in FIG. 15, structural element 184 is connected on the bottom front surface of the adapter plate 22 and the support plate 180 to enhance the structural integrity of the support 180. Two rollers 186 and 188 may be mounted on the bolting holes for supporting power tong 16 and transferring the force or torque that the power tong 12 applies to the pipe or pipe joint to the electrical or hydraulic load cell mounted on the brackets.

In some embodiments, the adapter plate 22 is bolted onto the bucking frame 10. The V-shaped structure 130 and the support structure 144 in FIGS. 1 and 11-12, or the support 180 and the vertical beams 168 and 170 in FIGS. 13-17 bolted with the power tong 12 or 16 provides machined spacers and bolts for a ⅛" gap for proper movement and torque transfer of the power tong 12 or 16.

The adapter plate 22 may receive different power tongs 12 or 16. In this regard, the adapter plate 22 may be configured to include a plurality of mounting points such as bolting holes or brackets with bolting holes that correspond to the mounting points of various power tongs 12 or 16 as described above. In some embodiments, the adapter plate 22 includes all of the possible mounting points of the power tong products of a manufacturer for receiving any one of the power tongs from the manufacturer. In some embodiments, the adapter plate 22 includes all of the possible mounting points of power tong products of various power tong manufacturers for receiving any one of the power tongs from these power tong manufacturers.

As such, by including the adapter plate 22 with mounting points corresponding to the mounting points of commercially available power tongs 12 or 16, and power tong may be mounted on or attach to the adapter plate 22. As such, the bucking frame 10 may receive commercially available power tongs 12 or 16 to make up or break up a pipe connection. Therefore, the adapter plate 22 allows the bucking frame 10 to adapt to a plurality of power tongs 12 or 16 and thus improves the utility of the bucking frame 10. As well, by mounting or attaching the power tong 12 or 16 to the adapter plate 22, the power tong 12 may float and transfer the force or torque applied to a pipe or a pipe joint to a hydraulic or electronic load cell described above, for monitoring the amount of force and torque that the power tong 12 applies to the pipes or the pipe joint.

After the pipes, a pipe joint, collar, or other tubular accessories are securely mounted on the back-up jaw unit 20 and on the power tong 12 or 16, the power tong 12 or 16 applies force or torque to the pipes, a pipe joint, collar, or other tubular accessories for making up or breaking out a pipe connection. The force or torque is transferred from the power tong 12 or 16 to the back-up jaw unit 20, and the force or torque stops when the back-up jaw unit 20 engages the bucking frame 10.

In operation, the bucking frame 10 is placed on level ground or other support surface. Hydraulic hoses may be connected with the power tong 12 or 16. The jaws 190 and 192 are installed in the housing of the jaw unit 20. The back-up jaw unit 20 first securely retains a first pipe or a first end of a pipe joint, the power tong 12 or 16 then engages a second pipe or the second end of the pipe joint. The power tong 12 or 16 then rotates the second pipe or the second end of the pipe joint to make up or break out a pipe connection. In some embodiments, the pipes or the pipe joint retained by the power tong 12 or 16 and the back-up jaw unit 20 are substantially horizontal with respect to the ground.

The top edge of the adapter plate 22 may be lower than the bottom of the pipe receiving aperture 194 and 196 of the respective power tongs 12 and 16.

In some embodiments, the bucking frame 10 may have a plurality of brackets mounted on the corners of the bucking frame 10. In the embodiment of FIGS. 1-12, the bracket 198 is mounted on the top surfaces of the vertical beams 32, 86 and the hydraulic ram 102; the bracket 200 is mounted on the top surfaces of the vertical beams 34, 88 and the hydraulic ram 104; the bracket 202 is mounted on the top surfaces of the vertical beams 38, 92, and the hydraulic ram 108; and the bracket ram 204 is mounted on the top surfaces of the vertical beams 36, 90 and the hydraulic ram 106. Each of the brackets 198, 200, 202 and 204 has a hole for receiving a string for hoisting the bucking frame 10 from a vehicle, such as a truck or a pick-up truck, to a site or from the site to the vehicle for transportation.

The adapter plate 22 mounted with the power tong 12 or 16 may then be mounted or bolted on the base 18 of the bucking frame 10 with the two vertical row of bolting holes (six) on the adapter plate. Alternatively, the adapter plate 22 may be first mounted on the base 18, and the power tong 12 or 16 may then be mounted/bolted on the adapter plate 22 with the two vertical rows of bolting holes (six) on the adapter plate 22. The power tongs 12 or 16 may provide more or less torque as needed during the pipe connection making up or breaking out process.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A portable bucking frame for making and breaking tubular connections, the frame comprising:

a base for supporting said frame on a support surface, said base having a front end and a rear end;

a pair of back-up jaws movably mounted to said base for receiving a tubular member; and an adapter plate mounted on said front end of said base wherein said plate is configured to receive and mount one of a plurality of power tongs whereby said plate is positioned between said back-up jaws and said tongs when said tongs are used for making or breaking tubular connections.

2. The frame as defined in claim 1 wherein said base includes a plurality of adjustable feet for adjusting a height of said frame relative said support surface.

3. The frame as defined in claim 2 wherein each of said feet include a hydraulic ram.

4. The frame as defined in claim 1 wherein said back-up jaws are movable along a pair of C-shaped channels horizontally positioned on said base.

5. The frame as defined in claim 1 wherein said adapter plate includes two vertical members mounted on a front surface of said plate close to side edges of said plate for mounting a bracket of said power tongs.

6. A bucking frame comprising:

a base to support said frame on a surface;

a back-up jaw unit mounted on said base, said jaw unit horizontally adjustable in relation to said base to position a tubular thereon; and an adapter plate mounted on a front end of said base, said plate adaptable to receive and mount multiple power tongs whereby said plate is positioned between said back-up jaws and said tongs.

7. The frame as defined in claim 6 wherein said base includes one or more adjustable feet for adjusting a height of said relative said surface.

8. The frame as defined in claim 7 wherein each of said feet includes a hydraulic ram.

9. The frame as defined in claim 6 wherein said frame includes a pair of C-shaped channels positioned along a length of said frame whereby said channel defines a slot for receiving a roller of said back-up jaw unit.

10. The frame as defined in claim 6 wherein said back-up jaw unit includes a left side and a right side housing, each of said side housings are configured to receive an adjustable jaw.

11. The frame as defined in claim 6 further comprising a driving mechanism for horizontally driving said back-up jaw unit.

12. The frame as defined in claim 11 wherein said driving mechanism is a hydraulic motor.

13. The frame as defined in claim 11 wherein said driving mechanism is a hydraulic ram.

14. A portable bucking frame for making and breaking tubular connections, the frame comprising:

an adjustable base for supporting said frame at a height above an underlying support surface;

a back-up jaw unit movably mounted to said base, said base including a pair of adjustable jaws for receiving and positioning a tubular thereon; and an adapter plate mounted on a front end of said base, said adapter plate including a base plate having multiple hole configurations to accommodate a plurality of power tongs whereby said adapter plate is positioned between said back-up jaws and said tongs when said tongs are used for making or breaking tubular connections.

15. The frame as defined in claim 14 further comprising a driving mechanism for horizontally driving said back-up jaw unit.

16. The frame as defined in claim 15 wherein said drive mechanism is a hydraulic motor.

17. The frame as defined in claim 15 wherein said drive mechanism is a hydraulic ram.

* * * * *